US006390902B1

(12) United States Patent
Chang et al.

(10) Patent No.: US 6,390,902 B1
(45) Date of Patent: May 21, 2002

(54) MULTI-CONDITIONER ARRANGEMENT OF A CMP SYSTEM

(75) Inventors: Ruoh-Haw Chang, Po-Tzu; Hung-Yu Kuo, Hsin-Chu Hsien; Yao-Hung Liu, Chung-Li; De-Can Liao, Hsin-Chu, all of (TW)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 09/875,504

(22) Filed: Jun. 6, 2001

(51) Int. Cl.[7] ..... B24B 5/00
(52) U.S. Cl. ..... 451/285; 451/443
(58) Field of Search ..... 451/41, 285, 287, 451/56, 443

(56) References Cited

U.S. PATENT DOCUMENTS 5,816,891 A * 10/1998 Woo ..... 451/6
6,095,908 A * 8/2000 Torii ..... 451/285
6,120,350 A * 9/2000 Zhou et al. ..... 451/21
6,250,994 B1 * 6/2001 Chopra et al. ..... 451/56
6,322,427 B1 * 11/2001 Li et al. ..... 451/56

* cited by examiner

*Primary Examiner*—Eileen P. Morgan
(74) *Attorney, Agent, or Firm*—Winston Hsu

(57) ABSTRACT

The present invention provides a multi-conditioner arrangement of a CMP system. The CMP system according to the present invention comprises a polishing table, a polishing pad positioned on the polishing table, a plurality of carrier heads on the polishing pad functioning in holding semiconductor wafers, and a plurality of conditioners positioned between the two neighboring carrier heads on the polishing pad for recovering the surface texture of the polishing pad. Herein, a plurality of conditioners are in a one-to-one arrangement to a plurality of carrier heads, each conditioner producing a back and forth motion in a radiant direction. Therefore, the lifetime of the polishing pad is extended, the wafer-to-wafer difference is reduced, and spatial coverage is increased.

10 Claims, 2 Drawing Sheets

MULTI-CONDITIONER ARRANGEMENT OF A CMP SYSTEM

BACKGROUND OF THE INVENTION

1. Field of the Invention

The present invention provides a chemical-mechanical polishing system, and more particularly, a chemical-mechanical polishing system of multi-conditioner arrangement.

2. Description of the Prior Art

The manufacturing of integrated circuits involves applying micro-circuit structures to form a set of whole devices, of which the method is highly precise and consists of multiple steps. With the trend of integrated circuit devices towards smaller size and larger integration, more process steps are necessary in order to achieve the multilevel structure on the semiconductor wafer. A multilevel metallization process is used extensively in the VLSI/ULSI process, whereby a plurality of metal interconnect layers and low dielectric constant materials are used to link each of the semiconductor devices on the semiconductor wafer and complete the whole stacked loop structure. However, these metal lines and semiconductor devices result in severe surface topography of integrated circuits that leads to difficulty in subsequent deposition or pattern transfer processes. Therefore, both the protruding deposition layer and uneven surface profile of the semiconductor wafer need to be removed by a planarization process.

Chemical-mechanical polishing (CMP) is the most commercially applied planarization technique. Chemical-mechanical polishing is similar to that of mechanical polishing in its use of the "blade" principle, of which adequate chemical additives react with the surface of the semiconductor wafer to polish the uneven surface profile of the wafer to achieve planarization. If the various process parameters are properly controlled, the CMP process can provide more than a 94% flatness of the polished surface. Therefore, the semiconductor industry has adopted the CMP process for its sub-micron semiconductor processes, since better planarization is obtained for the surface of the semiconductor wafer.

Please refer to FIG. 1. FIG. 1 is the schematic diagram of the structure of the CMP system 10 according to the 42 prior art. The prior art CMP system 10 comprises a polishing table 12 with a first rotational motor for controlling rotational speed, a polishing pad 14 on the polishing table 12 for polishing the surface of the semiconductor wafer 18, at least one wafer carrier head 16 positioned on the polishing pad 14, and a vertical driving motor and a second rotational motor for controlling the vertical movement and rotational speed of the carrier head 16, respectively. The wafer carrier head 16 is for holding a semiconductor wafer 18 so the front face of the semiconductor wafer 18 is downward and contacts with the polishing pad 14. A slurry supplier 20 above the CMP system 10 is connected to the system for supplying the slurry required for polishing the semiconductor wafer 18. A conditioner 22 positioned between the two neighboring wafer carrier head 16 on the polishing pad 14, controlled by a third driving motor, distributes the slurry on the surface of the polishing pad 14, as well as removes the polishing residue remaining on the polishing pad 14.

The water-based slurry basically comprises both an abrasive and a chemical additive. The abrasive additive is a colloidal Silica or dispersed Alumina. The size distribution of these large, solid polishing particles in the slurry is 0.1~2.0 $\mu$m. The chemical additive is mostly a mixture of a potassium hydroxide (KOH) solution and ammonia water ($NH_4OH$), used to corrode the surface of the semiconductor wafer and allow for easy removal of the corroded material. However, the composition of the slurry is dependent on the type of materials used during the CMP process.

The CMP process first involves horizontally fixing a semiconductor wafer 18 on the carrier head 16. The semiconductor wafer 18 is placed with the surface to be polished facing the surface of the polishing pad 14. The surface of the semiconductor wafer 18 is polished by both the rotation of the polishing pad 14 in a first direction 26 and the self-rotation of the carrier head 16 in a second direction 28. Concurrently, the slurry supplier device 20 evenly dispenses the slurry on the rotating polishing pad 14, whereby contact of the slurry with the surface of the semiconductor wafer 18 results in a chemical reaction between the slurry and the surface material to allow for easy removal of the reacted material. The semiconductor wafer 18 is also simultaneously pressed downward to allow for mechanical polishing of its surface. The polishing rate at the protrusion of the semiconductor wafer 18 surface is greater than that of the rest of the surface, to result in the overall planarization of the surface of the semiconductor wafer 18. During the polishing process, the surface material of the semiconductor wafer 18 is removed at a rate of several thousand angstroms per minute.

However, an increase in the quantity of wafers polished leads to a large accumulation of chemically-reacted byproduct on the polishing pad 14. As a result, the polishing pad 14 becomes unpolished and abraded to decrease both the polishing rate and lifetime of the CMP 10 system. Thus, a method to maintain both the lifetime of the CMP system 10 and the polishing rate involves restoring in-situ the polishing pad 14 by having the conditioner 22 remove the byproduct resulting from surface polishing in order to allow the polishing pad 14 to maintain a state suitable for continued wafer polishing.

In FIG. 1, the conditioner 22 has a rough surface and its material, such as a diamond abrasive, is dependent on the properties of the polished material. The conditioner 22 sweeps over the polishing pad 14 from left to right according to a third direction 24 in order to remove the byproduct resulting from polishing and to maintain the surface texture of the polishing pad 14. Since there are a plurality of carrier heads 16 on the polishing pad 14, the single conditioner 22 needs to remove the byproducts resulting from polishing of all the semiconductor wafers 18, to result in the following disadvantages: (1) Since there is only one conditioner 22 for a plurality of carrier heads 16, the polishing pad 14 requires extensive and frequent treatment to prevent the single conditioner 22 from being unable to completely remove the polishing byproduct, and hence the lifetime of the diamond abrasive of the polishing pad 14 and the conditioner 22 greatly decreases; (2) Following restoration in-situ of the polishing pad 14, the carrier head 16 contacting the polishing pad 14 earliest has a different polishing rate than the carrier head 16 contacting the polishing pad 14 latest to result in a difference in polishing rate between different wafers of the same batch; and (3) Since the single conditioner 22 uses a left and right sweeping method, spatial coverage is strict and limited.

SUMMARY OF THE INVENTION

It is therefore a primary objective of the present invention to provide a multi-conditioner arrangement of a CMP system so as to resolve the above-mentioned problems.

In the preferred embodiment of the present invention, the CMP system comprises a polishing table, a polishing pad positioned on the polishing table, a plurality of carrier heads on the polishing pad for supporting semiconductor wafers, and a plurality of conditioners positioned between the two neighboring carrier head 16 on the polishing pad 14 for maintaining the surface texture of the polishing pad. Herein, the plurality of conditioners 42 and the plurality of carrier heads are positioned in a one-to-one arrangement, each conditioner producing a back and forth motion in a radiant direction.

It is an advantage of the present invention that both the one-to-one arrangement of the carrier head o the conditioner and the back and forth motion of the conditioner results in the increase in the lifetime of the polishing pad, the decrease in the difference in wafer to wafer polishing rate, and an increase in spatial coverage.

These and other objectives of the present invention will no doubt become obvious to those of ordinary skill it in the art after reading the following detailed description of the preferred embodiment, which is illustrated in the various figures and drawings.

DETAILED DESCRIPTION OF THE PREFERRED EMBODIMENT

Figure 1:
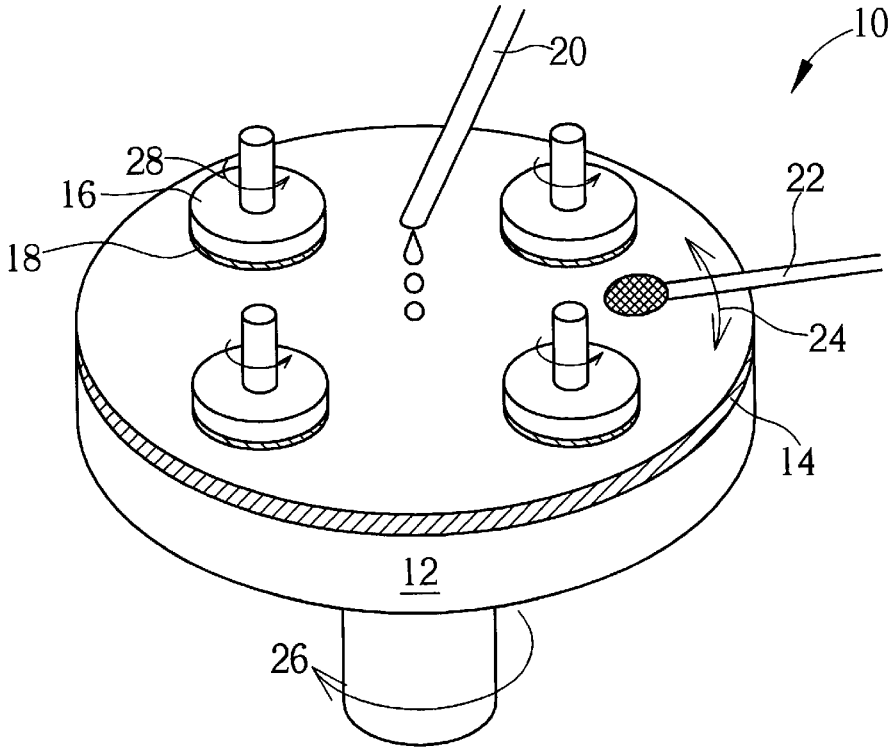
Fig. 1 Prior art
FIG. 1 is the schematic diagram of the structure of the CMP system according to the prior art.
Figure 2:
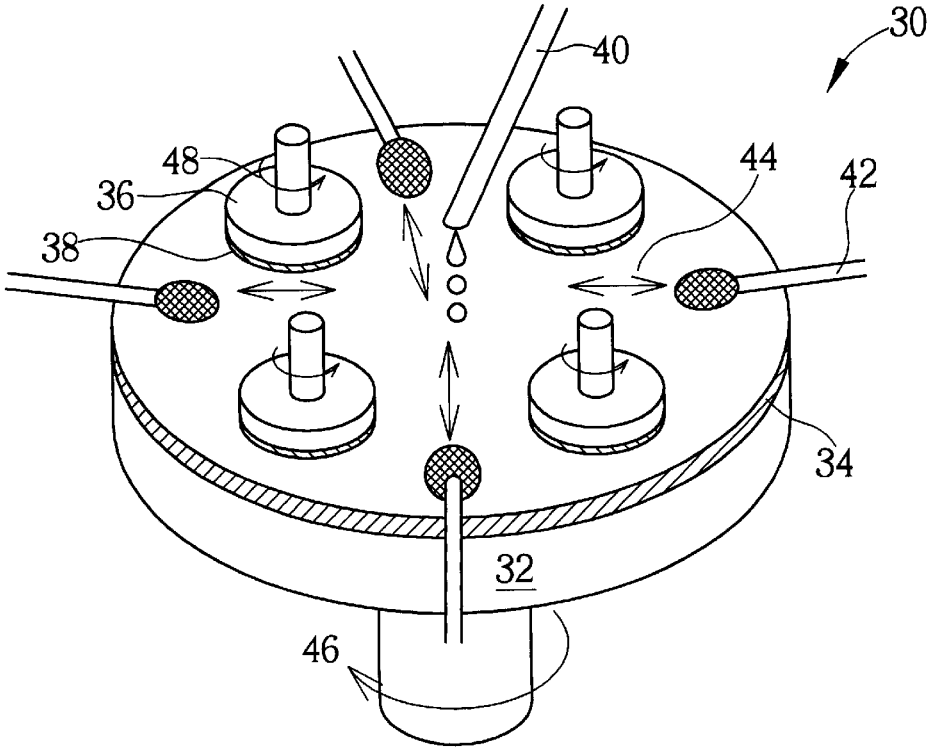
FIG. 2 is the schematic diagram of the structure of the CMP system of the first preferred embodiment according to the present invention.

Please refer to FIG. 2. FIG. 2 is the schematic diagram of the structure of the CMP system 30 according to the present invention. The CMP system 30 comprises a polishing table 32, a polishing pad 34 atop the polishing table 32, and four carrier heads 36 evenly-spaced on the polishing pad 34 for fixing each semiconductor wafer 38, whereby the surface to be polished contacts the polishing pad 34. A slurry supplier 40 installed above the CMP system 30 and connected to the CMP system 30 is used for supplying the slurry required for polishing of the semiconductor wafers 38. Four conditioners 42 on the polishing pad 34 are in a one-to-one arrangement to the carrier heads 36. Each conditioner 42 is positioned between the two neighboring carrier heads 36, and function both in distributing the slurry on the polishing pad 34 and removing the polishing byproduct remaining on the polishing pad 34.

In the preferred embodiment of the present invention, each conditioner 42 comprises a diamond planar grinding disc. However, the conditioner 42 of the present invention can also comprise of other similar stiff materials that are within the metes and bounds of the present invention. In another embodiment of the present invention, each conditioner 42 comprises a condition arm and a diamond planar grinding disc installed at one end of the condition arm.

In the CMP process, the semiconductor wafer 38 is first horizontally fixed on each of the carrier head 36, with the surface to be polished contacting the polishing pad 34. Then, the polishing pad 34 and the carrier head 36 rotate in a first direction 46 and a second direction 48, respectively, at a specific rotating speed to begin the polishing process. Concurrently, the four conditioners 42 produce a back and forth motion in a radiant direction 44 in order to remove the byproduct on the polishing pad 34. The areas on the polishing pad 34 which is polished by the semiconductor wafer 38 on the carrier head 36 is immediately restored in-situ by the conditioner 42. Therefore, each semiconductor wafer 38 is polished by the conditioned polishing pad 34 to greatly decrease the difference in wafer-to-wafer polishing rate.

Since the conditioner 42 according to the present invention is in a one-to-one arrangement to the carrier head 36, the conditioned polishing pad 34 is affected by one carrier head 36. Therefore, both less frequent and extensive treatment is required of the polishing pad 34 when the conditioner 42 is conditioning the polishing pad 34 to decrease the consumption of the surface of the conditioner 42 and the polishing pad 34 and increase the lifetime of the polishing pad 34. Moreover, since each carrier head 36 is polished by the conditioned polishing pad 34, both the polishing rate and the uniformity of each carrier head 36 is more easily controlled to greatly decrease wafer-to-wafer difference. Also, movement of the conditioner 42 in a front and back motion towards a radiant direction 44 increases spatial coverage.

Figure 3:
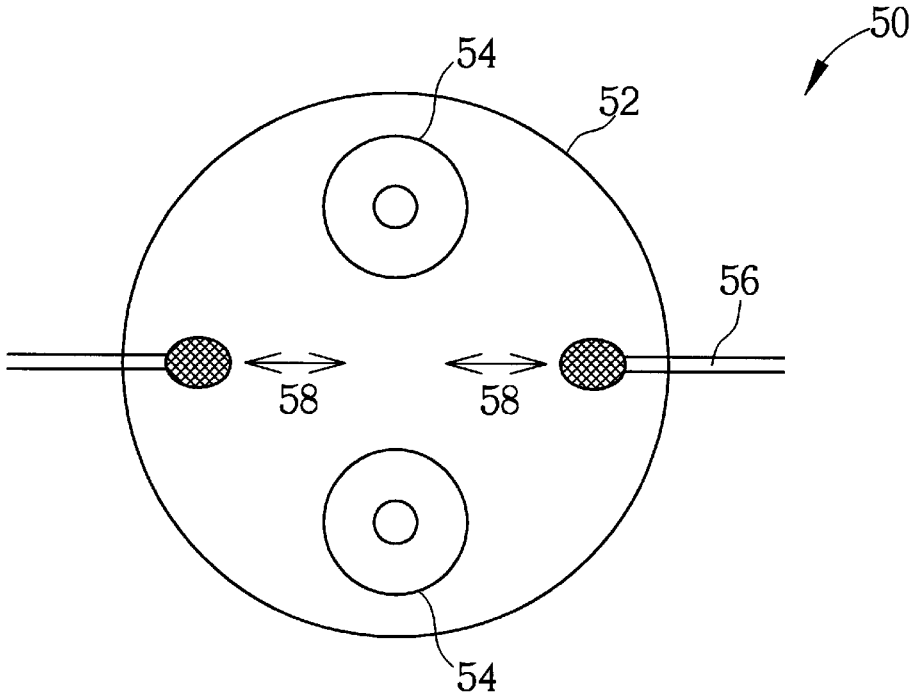
FIG. 3 is the top view of the CMP system of the second preferred embodiment according to the present invention.
Figure 4:
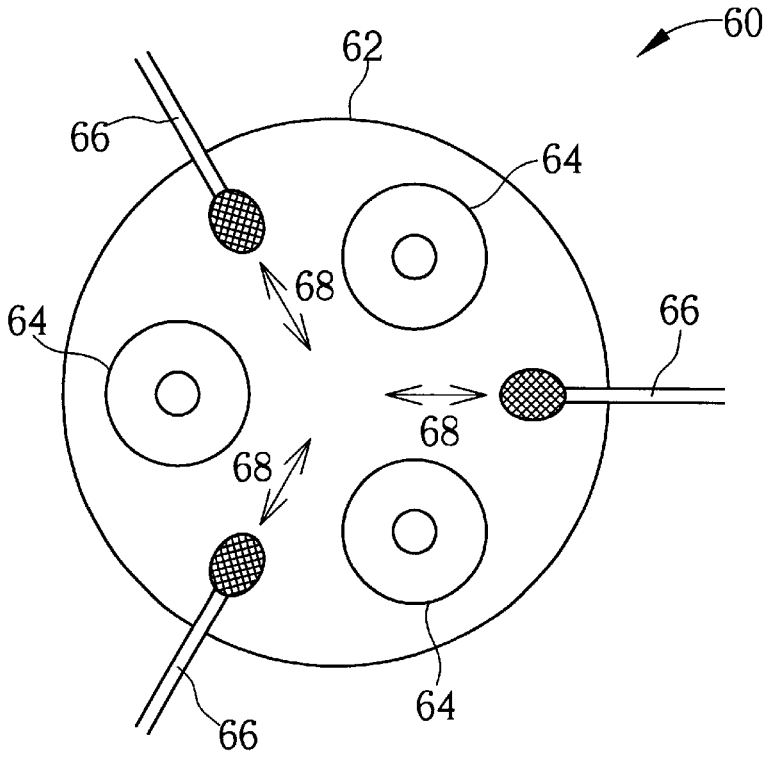
FIG. 4 is the top view of the CMP system of the third preferred embodiment according to the present invention.

Please refer to FIG. 3 and FIG. 4. FIG. 3 and FIG. 4 are the top views of the second and third embodiment, respectively, of the present invention. As shown in FIG. 3, one CMP system 50 comprises two carrier heads 54 positioned on the polishing pad 52, which is in a one-to-one arrangement with the two conditioners 56. Each conditioner 56 is positioned between two carrier heads 54. The conditioner 56 is driven by a third driving motor and the conditioner 56 produces a back and forth motion in a radiant direction 58.

As shown in FIG. 4, a CMP system 60 comprises three carrier heads 64 positioned on the polishing pad 62, which is in a one-to-one arrangement with the three conditioners 66. Each conditioner 66 is positioned between two carrier heads 64. The conditioner 66 is driven by a third motor and the conditioner 66 produces a back and forth motion in a radiant direction 68.

In contrast to the prior art CMP system, the present invention has a plurality of conditioners which is in a one-to-one arrangement with the carrier head. Therefore, the lifetime of the polishing pad is extended and the wafer-to-wafer difference occurring from the CMP process is reduced. Moreover, the back and forth motion in a radiant direction of the conditioner leads to greater spatial coverage.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A chemical mechanical polishing (CMP) apparatus, comprising:

a polish table;

a polish pad positioned on the polish table;

a plurality of carrier heads on the polishing pad, each carrier head functioning in supporting a wafer to be polished; and a plurality of pad conditioners positioned between the two neighboring carrier head on the polishing pad used to restore in-situ the polish pad to a state suitable for continued wafer polishing;

wherein the plurality of pad conditioners and the plurality of carriers are positioned in a one-to-one arrangement.

2. The CMP apparatus of claim 1wherein the polish table is controlled by a first motor, and rotates in a first direction.

3. The CMP apparatus of claim 1 wherein each of the plurality of carrier heads is controlled by a second motor, and rotates in a second direction.

4. The CMP apparatus of claim 1 further comprises a slurry supplier used to dispense the slurry onto the polish pad.

5. The CMP apparatus of claim 1 wherein each of the plurality of pad conditioners comprises a diamond planar grinding disc contacting the polish pad during pad conditioning.

6. The CMP apparatus of claim 5 wherein the rotation of the diamond planar grinding disc is controlled by a third motor.

7. A chemical mechanical polishing (CMP) apparatus having an improved multi-conditioner arrangement, the CMP apparatus comprising:

a polish table, wherein the rotational speed of the polish pad is controlled by a first motor;

a polish pad positioned on the polish table;

a plurality of carrier heads on the polishing pad functioning in supporting a wafer to be polished, and is controlled by a second rotation motor and a vertical motor to control its rotational speed and its vertical movement; and a plurality of pad conditioner positioned between the two neighboring carrier head on the polishing pad for maintaining the surface texture of the polishing pad;

wherein the plurality of pad conditioners and the plurality of carriers are positioned in a one-to-one arrangement.

8. The CMP apparatus of claim 7 wherein each of the pad conditioners comprises a condition arm and a diamond planar grinding disc, with the diamond planar grinding disc positioned at one end of the condition arm.

9. The CMP apparatus of claim 8 wherein the rotational speed of the diamond planar grinding disc is controlled by a third motor.

10. The CMP apparatus of claim 8 wherein the condition arm produces a back and forth motion in a radiant direction during the pad conditioning.

* * * * *